US005916281A

United States Patent [19]

Kester et al.

[11] Patent Number: 5,916,281

[45] Date of Patent: Jun. 29, 1999

[54] SHUTTLING THROW MEMBER FOR LOCKSET

[75] Inventors: Steve A. Kester, Noblesville; Scott A. Gilbertson, Indianapolis; John W. McIntire, Anderson, all of Ind.

[73] Assignee: Best Lock Corporation, Indianapolis, Ind.

[21] Appl. No.: 08/630,548

[22] Filed: Apr. 10, 1996

[51] Int. Cl.[6] ..... E05B 13/10

[52] U.S. Cl. ..... 70/224; 70/223; 70/422; 70/472

[58] Field of Search ..... 70/215–218, 221–224, 70/467, 470, 471, 473–485, 489, 149, 472, 422, 188, 189

[56] References Cited

U.S. PATENT DOCUMENTS

| | | | |
|---|---|---|---|
| 420,600 | 2/1890 | Hooper | 70/149 |
| 1,358,211 | 11/1920 | Huffman | 70/476 |
| 1,395,414 | 11/1921 | Huffman | 70/476 X |
| 1,408,652 | 3/1922 | Steinberg | 70/185 |
| 1,799,908 | 4/1931 | Keeler | 292/DIG. 27 X |
| 1,855,697 | 4/1932 | Sullivan | 70/223 |
| 2,065,683 | 12/1936 | Gahagan | 70/223 |
| 2,282,213 | 5/1942 | Rolph | 70/216 X |
| 2,848,886 | 8/1958 | Varrin et al. | 70/477 X |
| 2,998,274 | 8/1961 | Russell | 70/467 X |
| 3,127,208 | 3/1964 | Russell | 292/150 X |
| 4,099,395 | 7/1978 | Garza | 70/360 |
| 5,199,285 | 4/1993 | Lin | 70/224 X |

FOREIGN PATENT DOCUMENTS

| | | | |
|---|---|---|---|
| 53316 | 7/1937 | Denmark | 70/216 |
| 483934 | 10/1929 | Germany | 70/216 |

*Primary Examiner*—Lloyd A. Gall
*Attorney, Agent, or Firm*—Barnes & Thornburg

[57] ABSTRACT

A lockset is provided for use in a door. The lockset includes a lock core, a body mounted on the door, a door handle mounted on the body, a locking-unlocking mechanism, and a throw member mounted for rotation with the lock core. The locking-unlocking mechanism locks and unlocks the lockset in response to rotation of the key within the lock core. The throw member includes an outer perimeter edge, a blade extending toward the locking-unlocking mechanism, and a channel extending around the outer perimeter edge. The body also includes a pin that extends into the channel so that when a key is rotated in the lock core, the lock core and throw member rotate relative to the pin. This rotation causes the throw member to move from an inactive position disengaged from the locking-unlocking mechanism to an active position where the blade engages the locking-unlocking mechanism.

31 Claims, 6 Drawing Sheets

11
11

13
13

SHUTTLING THROW MEMBER FOR LOCKSET

BACKGROUND AND SUMMARY OF THE INVENTION

The present invention relates to a lockset having a shuttling throw member, and particularly to a lockset including a shuttling throw member connecting a lock core to a locking-unlocking mechanism in the lockset. More particularly, the present invention relates to a lockset having a key-operated lock core and a shuttling throw member that connects the lock core to the locking-unlocking mechanism in the lockset only when the key is inserted into the lock core and rotated a predetermined amount.

Locksets are well known as shown, for example, in U.S. Pat. Nos. 3,955,387 to Best, et al.; 4,424,691 and 4,437,695 to Foshee; and 4,262,507 to Flack et al. A lockset is a lockable unit that connects a door handle to a retractable latch bolt mounted in a door so that the door handle can be turned to retract the latch bolt and unlatch the door when the lockset is unlocked. Once the lockset is locked, the latch bolt cannot be retracted to unlatch the door by turning the door handle. Typically, a lockset is mounted in a lockset-receiving aperture provided in a door in a location adjacent to the door handle and latch bolt.

A lockset typically includes a locking-unlocking mechanism for locking and unlocking the lockset. When the lockset is locked, latch bolt retraction is prevented to lock the door in a closed position. When the lockset is unlocked, the latch bolt may be retracted to allow the door to open upon rotation of the door handle.

Everyone has operated a locking-unlocking mechanism in a lockset by inserting an operating key into a lock core mounted in a door handle and turning the operating key. A lock core typically includes a rotatable key plug formed to include a keyway sized to receive the operating key. A throw member is usually provided to transmit rotation of the key plug (caused by turning of an operating key) in the lock core to a locking-unlocking mechanism provided in the lockset to control movement of a locking lug relative to a retractable latch bolt. Usually, a person is able to operate the locking-unlocking mechanism in the lockset simply by turning an operating key enough to rotate the key plug, the throw member connected to the key plug, and the locking-unlocking mechanism.

Consumers would appreciate a lockset having a throw member that disengages the locking-unlocking mechanism when the operating key is removed from the lock core. A throw member that could "shuttle" automatically to a position disengaging the locking-unlocking mechanism in a lockset would increase the security of the lockset, especially when excessive torque is applied to a door handle of a locked lockset in an attempt to "break" the lockset.

According to the present invention, a throw member is provided for use in a lockset. The lockset includes a rotatable door handle, a lock core, and a locking-unlocking mechanism for locking and unlocking the lockset. The throw member is configured and controlled to connect the lock core to the locking-unlocking mechanism when an operating key is inserted into a keyway provided in the lock core and rotated a predetermined amount. The locking-unlocking mechanism is operated by rotating the operating key in the lock core.

The throw member is mounted in the lockset for rotation about an axis of rotation and for reciprocation along the axis of rotation so that it can shuttle back and forth between an enabled position engaging the locking-unlocking mechanism and a disabled position disengaging the locking-unlocking mechanism. The throw member includes a blade extending away from the door handle and a mechanism for shuttling the blade axially along the axis of rotation relative to the door handle between its enabled and disabled positions. The shuttling is provided so that when the operating key is inserted into the lock core and rotated a predetermined amount, the blade on the throw member is moved to engage and rotate the locking-unlocking mechanism so as to lock or unlock the lockset.

During removal of the key from the lock core, the blade on the throw member is moved to its disabled position to disengage the locking-unlocking mechanism. Disengaging the throw member from the locking-unlocking mechanism when the operating key is removed from the lock core prevents the blade of the throw member from shearing off during an overtorque attack on the lockset. Further, the disengaging feature helps keep a locked lockset in a locked position during an overtorque attack on the lockset.

In preferred embodiments the throw member includes the blade, a pair of spaced-apart drive prongs, and a circular disk or body portion between the blade and the drive prongs. The blade projects away from one side of the body portion toward the locking-unlocking mechanism and the pair of spaced-apart drive prongs project away from the other side of the body portion and engage a key plug mounted for rotation in the lock core and configured to include a keyway.

A camming mechanism is provided in the lockset to shuttle the throw member axially along the axis of rotation as the throw member is rotated by rotation of the operating key and the rotatable key plug in the lock core about the axis of rotation. One part of the camming mechanism is formed in the circular body portion included in the rotatable and reciprocable throw member and another part of the camming mechanism is mounted in a fixed position in the lockset to engage the circular body portion as it rotates.

The camming mechanism functions to move the throw member axially along the axis of rotation between a disabled position disengaging the locking-unlocking mechanism and an enabled position engaging the locking-unlocking mechanism. More specifically, the throw member is shuttled into the enabled position engaging the locking-unlocking mechanism by the camming mechanism whenever the operating key is inserted into the keyway formed in the rotatable key plug mounted in the lock core and turned a predetermined amount. Whenever the operating key is removed from the lock core, the throw member is shuttled by the camming mechanism into the disabled position disengaging the locking-unlocking mechanism.

In preferred embodiments of the invention, the throw member includes an outer perimeter edge on the circular body portion and a serpentine channel formed in the circular body portion to extend around the outer perimeter edge. A pin is fixed relative to the door handle and extends into the serpentine channel. The serpentine channel and the pin cooperate to define the camming mechanism. As the throw member is rotated in response to rotation of the operating key within the lock core, the pin cams the throw member to move the throw member axially along the axis of rotation.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
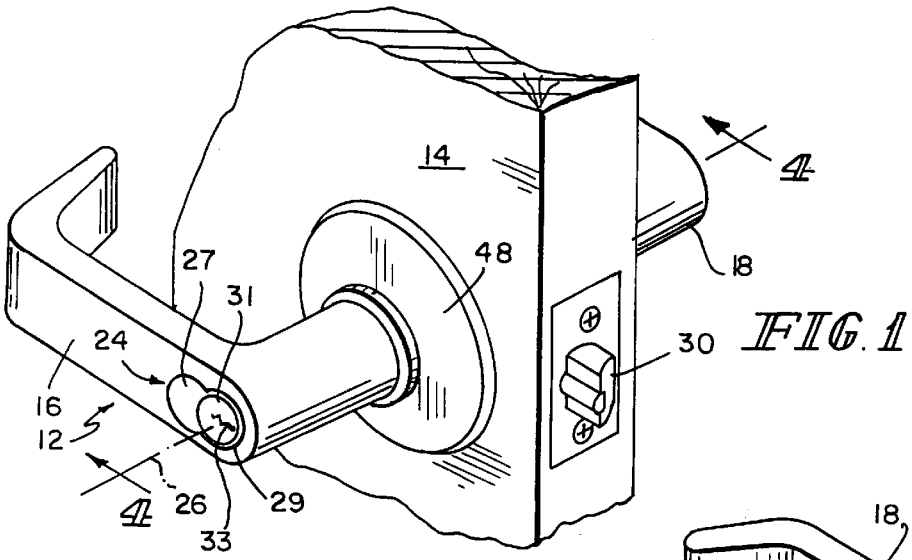
FIG. 1 is a perspective view of a lockset mounted on a door.

A shuttling throw member 10 for use in a lockset 12 is shown in FIGS. 2–4, 6, 8, 10, and 12. The lockset 12 is generally mounted to a door 14 as shown in FIG. 1. When the lockset 12 is in an unlocked position, an outer door handle 16 or inner door handle 18 can be rotated about an axis of rotation 26 to latch and unlatch door 14. In a locked position, the lockset 12 is disabled to prevent door 14 from being unlatched.

Figure 2:
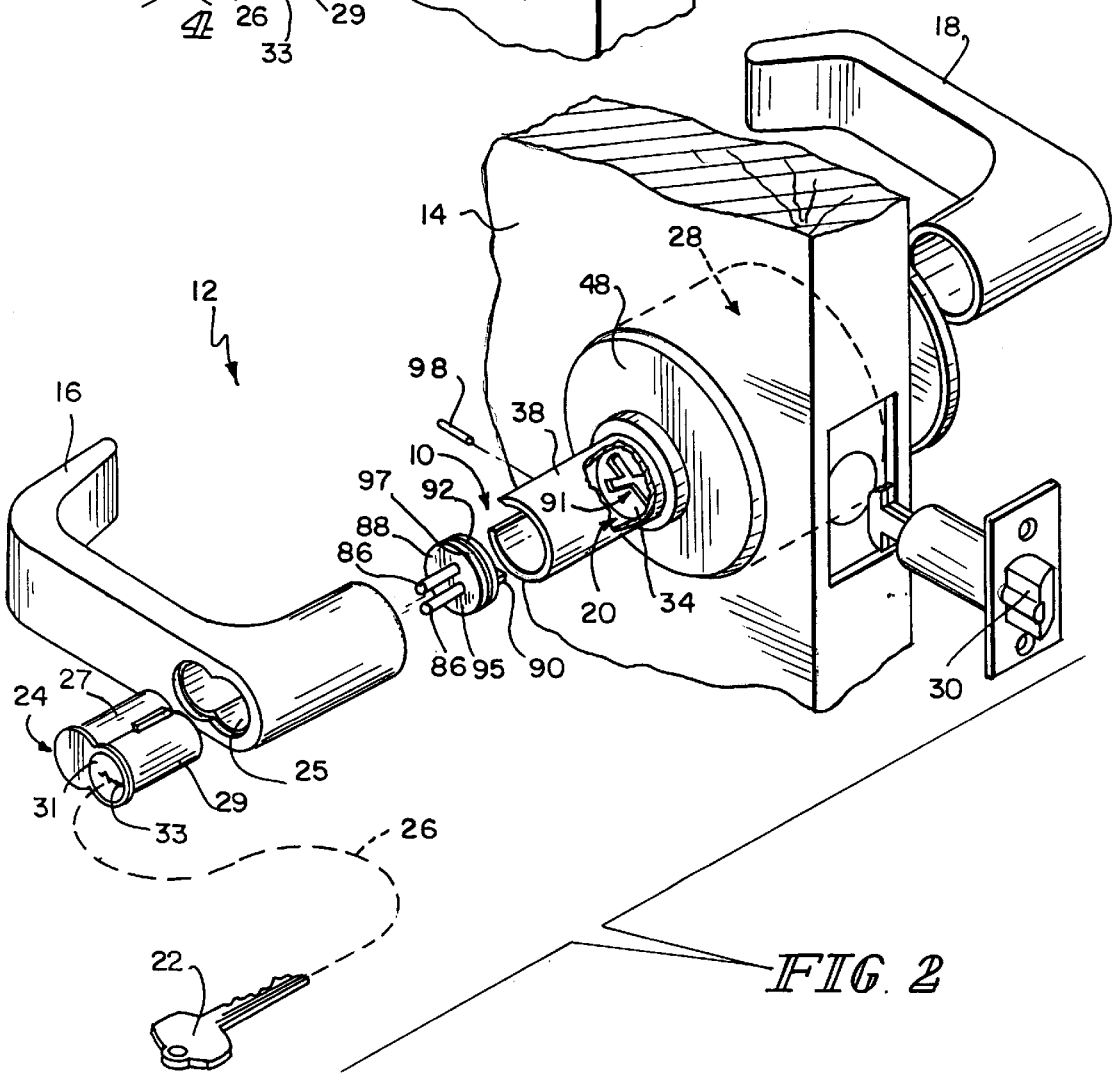
FIG. 2 is an exploded perspective view of the lockset of FIG. 1 showing several components of the lockset including an operating key, a figure-8-shaped lock core containing a rotatable key plug having a keyway for receiving the operating key, an outer door handle, a shuttling throw member, a first outer spindle, a first key drive spindle formed to include an X-shaped central aperture for receiving the shuttling throw member, a pin mounted on the outer spindle, a latch bolt for extending out of the door, and an inner door handle.
Figures 3, 4, 5:
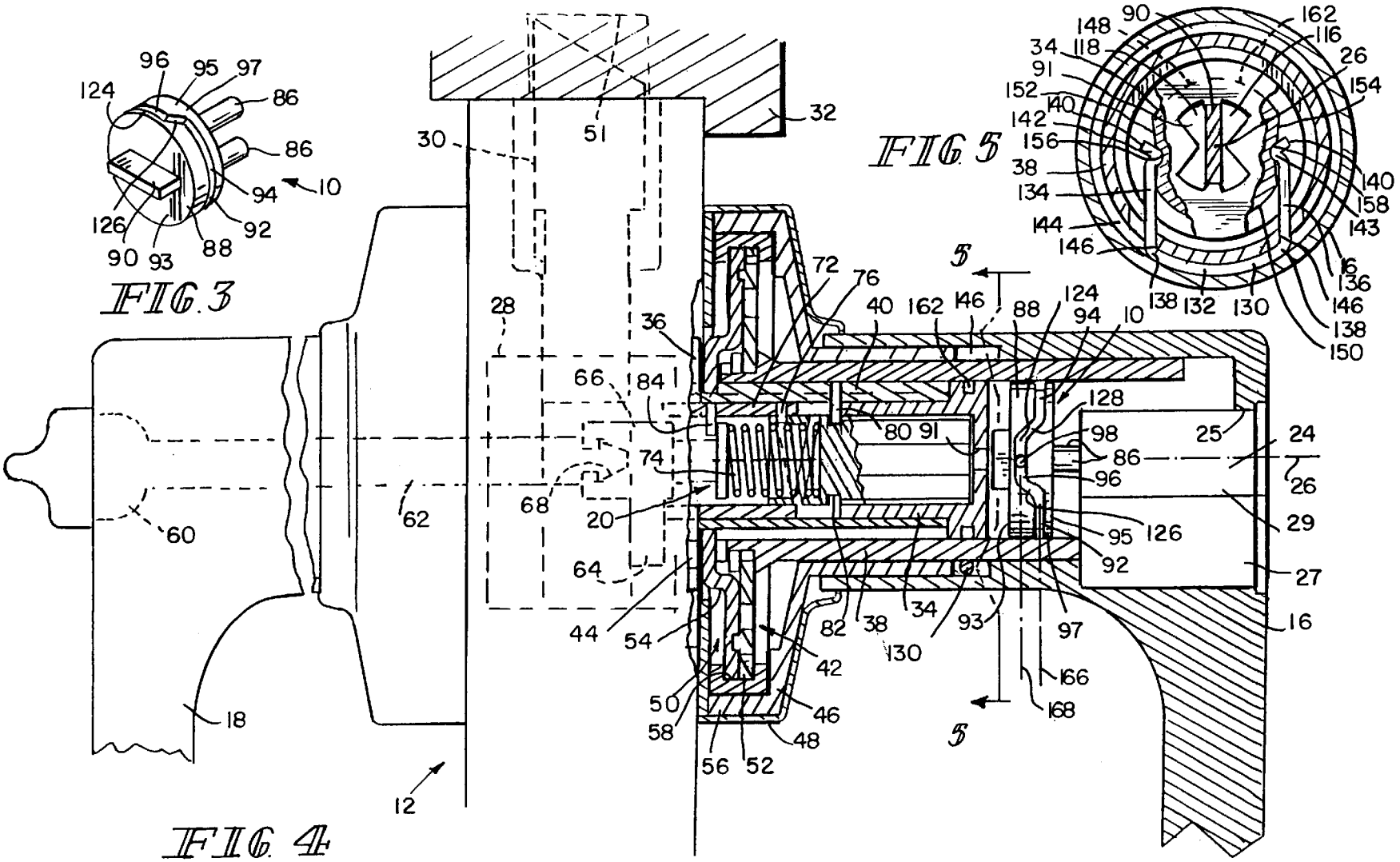
FIG. 3 is a perspective view of the shuttling throw member of FIG. 2 showing a body portion having a circumferentially extending serpentine channel, a rectangular-shaped blade appended to one side of the body portion and arranged to engage the first key drive spindle; and a pair of spaced-apart drive prongs for insertion into two prong-receiving holes formed in the key plug in the lock core.
FIG. 4 is a longitudinal sectional view taken along line 4—4 of FIG. 1 of the lockset in an unlocked position and showing the shuttling throw member mounted within the lock core and located in a position that is disengaged and spaced apart from the first key drive spindle.
FIG. 5 is a cross sectional view taken along line 5—5 of FIG. 4 showing an X-shaped aperture formed in the first key drive spindle and the position of the rectangular-shaped blade of the shuttling throw member relative to the X-shaped aperture when the lockset is in the unlocked position and the operating key is removed from the lock core.
Figures 10, 11:
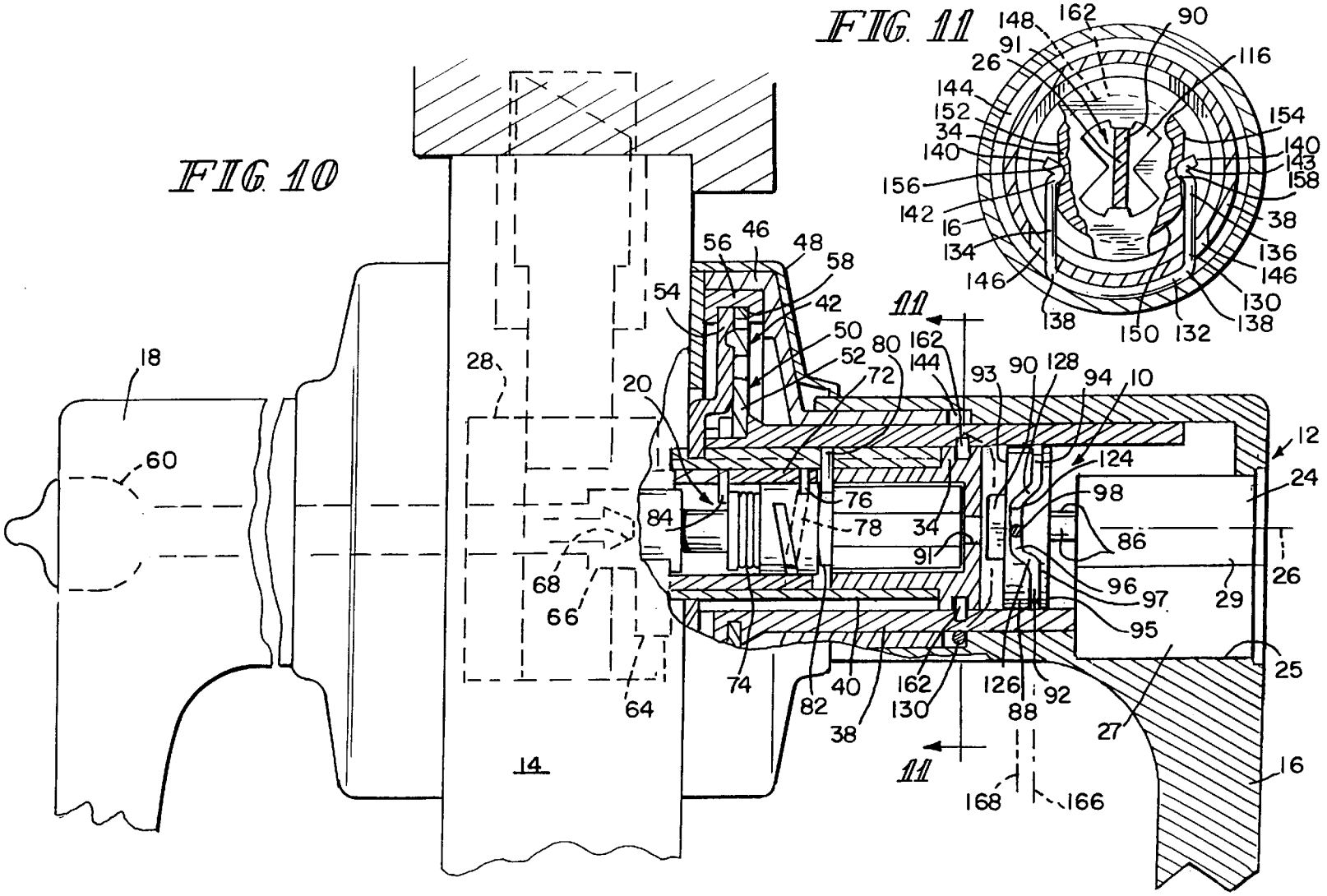
FIG. 10 is a longitudinal sectional view similar to FIG. 8 showing the lockset in the locked position and the operating key removed from the lock core.
FIG. 11 is a cross sectional view taken along line 11—11 of FIG. 10 showing the position of the rectangular-shaped blade of the throw member relative to the X-shaped aperture formed in the first key drive spindle.

Lockset 12 includes a locking-unlocking mechanism 20 that locks lockset 12, as shown in FIG. 10, and unlocks lockset 12 as shown in FIG. 4. An operating key or token 22 is used to activate the locking-unlocking mechanism 20. As shown in FIGS. 1 and 2, lock core 24 is a figure-8-shaped piece having an upper lobe 27 and a lower lobe 29. A cylindrical key plug 31 is mounted for rotation in a longitudinally extending passageway formed in lower lobe 29 of lock core 24. Key plug 31 is formed to include a longitudinally extending keyway 33 for receiving operating key 22 therein. Lock core 24 is mounted in a lock core-receiving aperture 25 formed in outer door handle 16 as shown in FIGS. 1 and 2.

Shuttling throw member 10 transfers rotation from operating key 22 to locking-unlocking mechanism 20. More specifically, operating key 22 rotates key plug 31 mounted in lock core 24 and shuttling throw member 10 transfers rotation from key plug 31 to a first key drive spindle 34 and a second key drive spindle 70 of locking-unlocking mechanism 20 as shown in FIGS. 4–13.

Significantly, shuttling throw member 10 only engages first key drive spindle 34 when operating key 22 is inserted into keyway 33 of key plug 31 of lock core 24 and rotated a predetermined amount. The operating key 22 rotates key plug 31 which rotates shuttling throw member 10. When operating key 22 is removed from lock core 24, shuttling throw member 10 disengages first key drive spindle 34 of locking-unlocking mechanism 20. Therefore, locking-unlocking mechanism 20 is operable only when operating key 22 is inserted into key plug 33 of lock core 24 and rotated a predetermined amount.

The lockset 12 transfers rotation from outer door handle 16 or inner door handle 18 to a centrally located latch bolt retractor assembly 28 to latch and unlatch door 14. Latch bolt retractor assembly 28 is mounted within a hub 36 situated in door 14 and is connected to a latch bolt 30. The latch bolt retractor assembly 28 can be operated to retract latch bolt 30 from a projected position engaging a door frame 32, as shown in FIG. 4, to a retracted position lying inside door 14 and disengaging door frame 32. Operating key 22, lock core 24, outer door handle 16, shuttling throw member 10, first key drive spindle 34, latch bolt retractor assembly 28, latch bolt 30, and inner door handle 18 are shown in an exploded view in FIG. 2.

The lockset 12 also includes a rotatable first outer spindle 38 carrying outer door handle 16 and a rotatable second outer spindle or body 40 rotatably coupled with rotatable first outer spindle 38 through a disconnecting clutch mechanism 42 as shown in FIGS. 4, 6, 8, 10, and 12. Second outer spindle 40 includes a spindle cam ear 44 extending axially inward to engage latch bolt retractor assembly 28. In normal operating conditions, disconnecting clutch mechanism 42 transfers rotation from door handle 16 to latch bolt retractor assembly 28.

Disconnecting clutch mechanism 42 enhances the security of a locked lockset 12 and the integrity of an unlocked lockset 12 when lockset 12 is subject to an overtorque attack. During such an overtorque attack on lockset 12, disconnecting clutch mechanism 42 disconnects to prevent rotational driving forces (torque) from being transferred from door handle 16 to latch bolt retractor assembly 28.

An outer rose liner 46 surrounds disconnecting clutch mechanism 42 and a rose 48 covers rose liner 46. The lockset 12 includes a housing which is one or more of door handle 16, hub 36, first and second outer spindles 38, 40, outer rose liner 46, and rose 48. The rose liner 46 and first outer spindle 38 define an interior region 50 in which disconnecting clutch mechanism 42 is situated. In alternative embodiments of the present invention, the lockset may not include a disconnectable clutch mechanism or the disconnectable clutch mechanism may be situated outside of interior region 50.

When door 14 is in a closed position, latch bolt 30 is spring-biased to extend outwardly away from door 14 and into door frame 32 as shown in FIG. 4. More specifically, latch bolt 30 extends into a cavity 51 formed in door frame 32 when latch bolt 30 is in its extended door-latching position.

Door 14 is opened by rotating either outer door handle 16 or inner door handle 18 about axis of rotation 26. Rotation of outer door handle 16 rotates first outer spindle 38 relative to hub 36, rose liner 46, and rose 48. When lockset 12 is in the unlocked position, rotation of first outer spindle 38 rotates disconnecting clutch mechanism 42 which then transfers rotational driving force to second outer spindle 40. Rotation of second outer spindle 40 rotates spindle cam ear 44 to drive latch bolt retractor assembly 28 and retract latch bolt 30 to the retracted door-unlatching position within door 14.

The disconnecting clutch mechanism 42, shown in FIGS. 4, 6, 8, 10, and 12 includes a first spring drive plate 52 mounted for rotation on first outer spindle 38 and a second spring drive plate 54 mounted for rotation on second outer spindle 40. The first and second spring drive plates 52, 54 are assembled within a spring drive plate housing 56 that is situated within interior region 50. Spring drive plate housing 56 is formed to include an annular slot 58 in which first and second spring drive plates 52, 54 are assembled. First and second spring drive plates 52, 54 are shown in their assembled position in FIGS. 4, 6, 8, 10, and 12.

First and second spring drive plates 52, 54 cooperate to permit rotational driving force (i.e. torque) to be transferred from outer door handle 16 to latch bolt retractor assembly 28, when desired. However, if a person exerts excessive torque on outer door handle 16, first and second spring drive plates 52, 54 prevent rotational driving force (i.e. torque) from being transferred from door handle 16 to latch bolt retractor assembly 28 to prevent the person from gaining access through door 14.

First and second spring drive plates 52, 54 are mounted within spring drive plate housing 56 to engage each other so that in normal operating conditions when lockset 12 is in the unlocked position, rotational driving force (i.e. torque) is transferred from outer door handle 16 to second spring drive plate 54 through first spring drive plate 52. Rotation of second spring drive plate 54 rotates second outer spindle 40 to rotate spindle cam ear 44 and drive latch bolt retractor assembly 28 to unlatch door 14.

During an overtorque attack, first and second spring drive plates 52, 54 disconnect and disengage so that rotational driving force (i.e. torque) is not transferred from first spring drive plate 52 to second spring drive plate 54 in response to rotation of outer door handle 16 about axis of rotation 26. Therefore, spindle cam ear 44 is not rotated to drive latch bolt retractor assembly 28 and retract latch bolt 30 to the retracted door-unlatching position.

Disconnectable clutch mechanism 42 protects and increases the security of lockset 12 as a result of first and second spring drive plates 52, 54 camming apart. In the locked position, further rotation of outer door handle 16 after plates 52, 54 cam apart does not retract latch bolt 30 to allow door 14 to open because no rotational driving force is transferred from first spring drive plate 52 to second spring drive plate 54. Also, components within lockset 12 are protected because the excessive torque exerted on outer door handle 16 is not transmitted through lockset 12.

The shuttling throw member 10 is essential to ensure that lockset 12 is secure from an overtorque attack. The shuttling throw member 10 is essential because lock core 24 always rotates with door handle 16. After outer door handle 16 is overtorqued causing disconnectable clutch mechanism 42 to disconnect and disengage, outer door handle 16 is still permitted to rotate. Thus, lock core 24 and shuttling throw member 10 rotate with outer door handle 16 even when disconnectable clutch mechanism 42 is disengaged and disconnected.

If shuttling throw member 10 is permitted to rotate locking-unlocking mechanism 20, the lockset 12 will be unlocked and/or latch bolt 30 will retract to permit door 14 to open. The shuttling throw member 10 prevents locking-unlocking mechanism 20 from being operated when door handle 16 is rotated during an overtorque attack by disengaging first key drive spindle 34 of locking-unlocking mechanism 20 when operating key 22 is removed from lock core 24.

The lockset 12 can be locked and unlocked by rotating operating key 22 within lock core 24 or operating a push button 60 mounted in inner door handle 18. Push button 60 is connected to a button bar 62. When operated, push button 60 moves button bar 62 to operate locking-unlocking mechanism 20 and lock and unlock lockset 12.

More specifically, operating key 22 and push button 60 operate locking-unlocking mechanism 20 to move a locking lug 64 between its locked position and its unlocked position. The locking lug 64 is appended to a locking lug bushing 66 that travels axially inwardly and outwardly along axis of rotation 26. Locking lug bushing 66 is formed to include a button bar-receiving aperture 68 to receive one end of button bar 62 so that movement of button bar 62 moves locking lug 64.

In the locked position, locking lug 64 is positioned to couple second outer spindle 40 to hub 36 to prevent second outer spindle 40 from rotating relative to hub 36. Thus, in the locked position, spindle cam ear 44 cannot be rotated and latch bolt retractor assembly 28 cannot be driven to retract latch bolt 30.

In the unlocked position, locking lug 64 is situated so that second outer spindle 40 is permitted to rotate relative to hub 36. Thus, in the unlocked position, spindle cam ear 44 can drive latch bolt retractor assembly 28 to latch and unlatch door 14.

Locking-unlocking mechanism 20 further includes second key drive spindle 70, a locking cam 72, and a compression spring 74. Second key drive spindle 70 is mounted for rotation with first key drive spindle 34 so that rotation of shuttling throw member 10 is transferred from first key drive spindle 34 to second key drive spindle 70.

Rotation of second key drive spindle 70 causes locking cam 72 to transmit axially along axis of rotation 26 and rotationally about axis of rotation 26. A drive pin 76 connects locking cam 72 and second key drive spindle 70 as shown in FIGS. 4, 6, 8, 10, and 12. The drive pin 76 is fixed to locking cam 72 and arranged to extend into a helical slot 78 formed in second key drive spindle 70. A pin 80 is appended to second outer spindle 40 and is arranged to extend into a circumferentially extending slot 82 formed in second key drive spindle 70. The pin 80 prevents second key drive spindle 70 from moving axially along axis of rotation 26 but permits second key drive spindle 70 to rotate about axis of rotation 26. As second key drive spindle 70 rotates, drive pin 76 is moved through helical slot 78 of second key drive spindle 70 to move locking cam 72 axially along axis of rotation 26.

The locking lug bushing 66 is connected to locking cam 72 by a locking lug bushing pin 84 and compression spring 74 biasing locking lug bushing 66 into engagement with locking lug bushing pin 84. Axial movement of locking cam 72 along axis of rotation 26 moves locking lug bushing 66 and locking lug 64 axially along axis of rotation 26 between the locked and unlocked positions. Compression spring 74 biases locking lug 64 toward its unlocked position.

Locking cam 72 includes a locking cam cam ear (not shown) engaged with latch bolt retractor assembly 28. Rotation of locking cam 72, as a result of operating key 22 rotation, causes locking cam cam ear (not shown) to drive latch bolt retractor assembly 28 to unlatch door 14.

Shuttling throw member 10 disengages first key drive spindle 34 when operating key 22 is removed from lock core 24 so that locking-unlocking mechanism 20 may not operate when operating key 22 is removed from lock core 24. Shuttling throw member 10 is shown in detail in FIG. 3. Shuttling throw member 10 includes spaced-apart drive prongs 86 extending into longitudinally extending apertures (not shown) formed in rotatable key plug 31 mounted in lock core 24, a circular body portion 88, and a rectangular-shaped blade 90. The blade 90 is appended to body portion 88 and arranged to extend toward latch bolt retractor assembly 28.

Body portion 88 is a circular disk as shown in FIG. 3. The body portion 88 includes an annular exterior side wall 97, and inner and outer circular end walls 93, 95. Inner circular end wall 93 faces toward latch bolt retractor assembly 28 and outer circular end wall 95 faces away from latch bolt retractor assembly 28. The body portion 88 further includes a circumferentially extending serpentine channel 92 extending around the annular exterior side wall 97 of body portion 88. The annular exterior side wall 97 is the outer perimeter edge of body portion 88. The rectangular-shaped blade 90 is appended to inner circular end wall 93 and spaced-apart drive prongs 86 are appended to outer circular end wall 95.

The circumferentially extending serpentine channel 92 varies in distance axially from outer door handle 16 as serpentine channel 92 extends around the annular exterior side wall 97 of body portion 88. Circumferentially extending serpentine channel 92 includes a linear portion 94 extending along a first arcuate plane 166 and a C-shaped offset portion 96 as shown in FIGS. 3, 4, 6, 8, 10, and 12. C-shaped offset portion 96 includes a middle portion 124 extending along a second arcuate plane 168 and first and second end portions 126, 128 connecting middle portion 124 to linear portion 94. A pin or drive member or cam member 98 fixed to first spindle 38 extends into circumferentially extending serpentine channel 92.

The rectangular-shaped blade 90 selectively engages and disengages an X-shaped aperture 91 formed in first key drive spindle 34 as shuttling throw member 10 shuttles axially along axis of rotation 26. Throw member 10 shuttles axially along axis of rotation 26 due to an "inverse cam relationship" between pin 98 and circumferentially extending serpentine channel 92.

As shuttling throw member 10 is rotated by key plug 31 turned by operating key 22, the circumferentially extending serpentine channel 92 is rotated causing pin 98 to "travel" through circumferentially extending serpentine channel 92. As the shuttling throw member 10 is rotated by key plug 31, the pin 98 does not move because it is fixed to first outer spindle 38 as shown in an exploded view in FIG. 2. However, the pin 98 changes location ("travels") within the circumferentially extending serpentine channel 92 as the circumferentially extending serpentine channel 92 is rotated. The shuttling throw member 10 shuttles axially along axis of rotation 26 as circumferentially extending serpentine channel 92 rotates to change the location of pin 98 between linear portion 94 and C-shaped offset portion 96 of circumferentially extending serpentine channel 92.

Figures 12, 13:
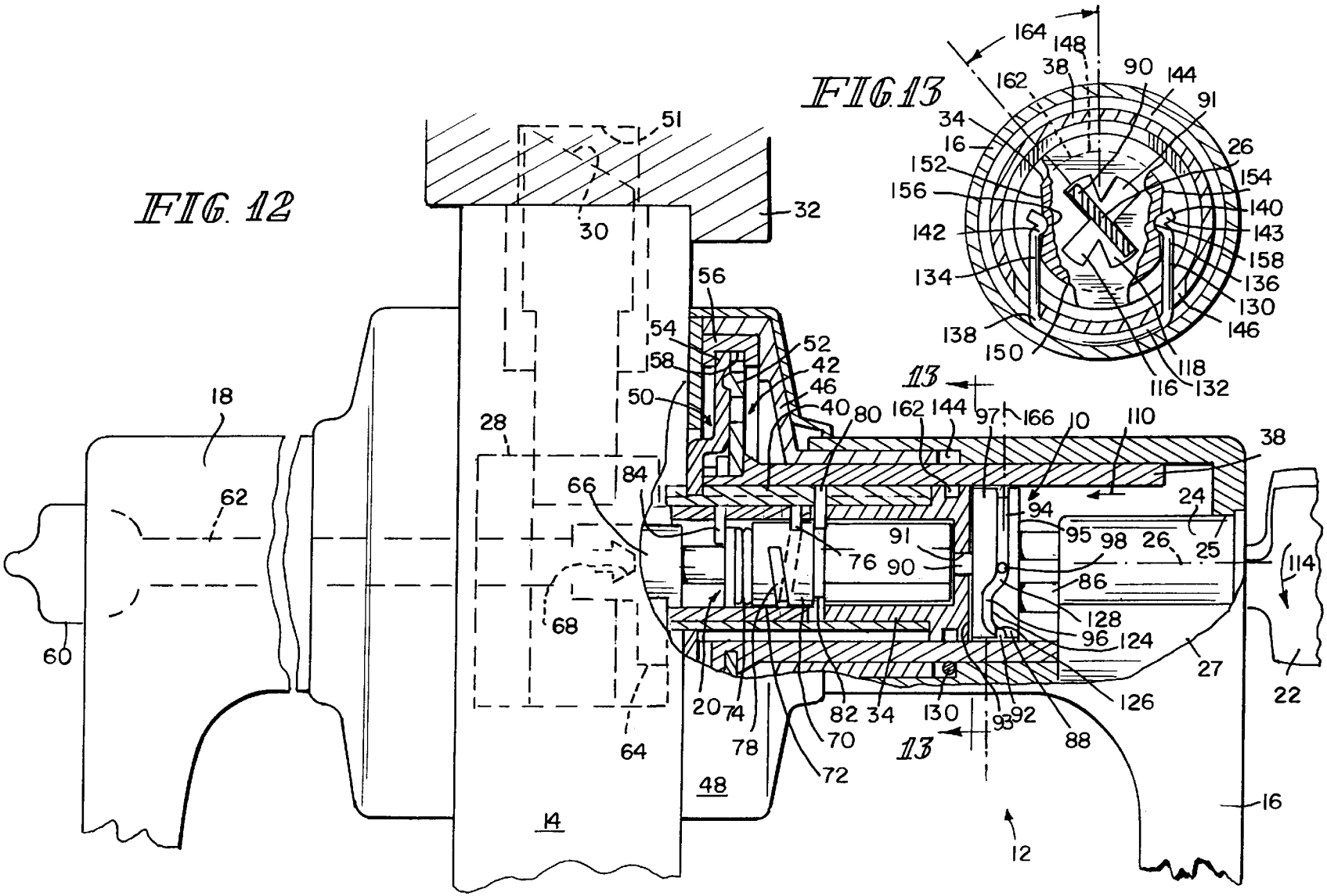
FIG. 12 is a longitudinal sectional view similar to FIG. 10 showing the lockset with the operating key inserted into the lock core and rotated in an unlocking direction a predetermined amount to shuttle shuttling throw member axially forward so that the rectangular-shaped blade engages the X-shaped aperture of the first key drive spindle and further rotation of operating key in the unlocking direction begins rotating first key drive spindle to move components of the lockset toward the unlocked position.
FIG. 13 is a cross sectional view taken along line 13—13 showing the position of the rectangular-shaped blade relative to the X-shaped aperture when the operating key has been rotated within the lock core a predetermined amount in the unlocking direction to place the rectangular-shaped blade within the X-shaped aperture.

Shuttling throw member 10 is shown assembled within lockset 12 in FIGS. 4, 6, 8, 10, and 12. FIGS. 4–11 show the movement of lockset 12 as operating key 22 is inserted into lock core 24 of lockset 12 in the unlocked position, rotated 360° in a locking direction 112 within lock core 24 to rotate first key drive spindle 34 360° and lock lockset 12, and removed from lock core 24. FIGS. 11 and 12 show operating key 22 inserted into lock core 24 of lockset 12 in a locked position and rotated in an unlocking direction 114 a predetermined amount to cause rectangular-shaped blade 90 to engage X-shaped aperture 91 of first key drive spindle 34.

Figures 6, 7:
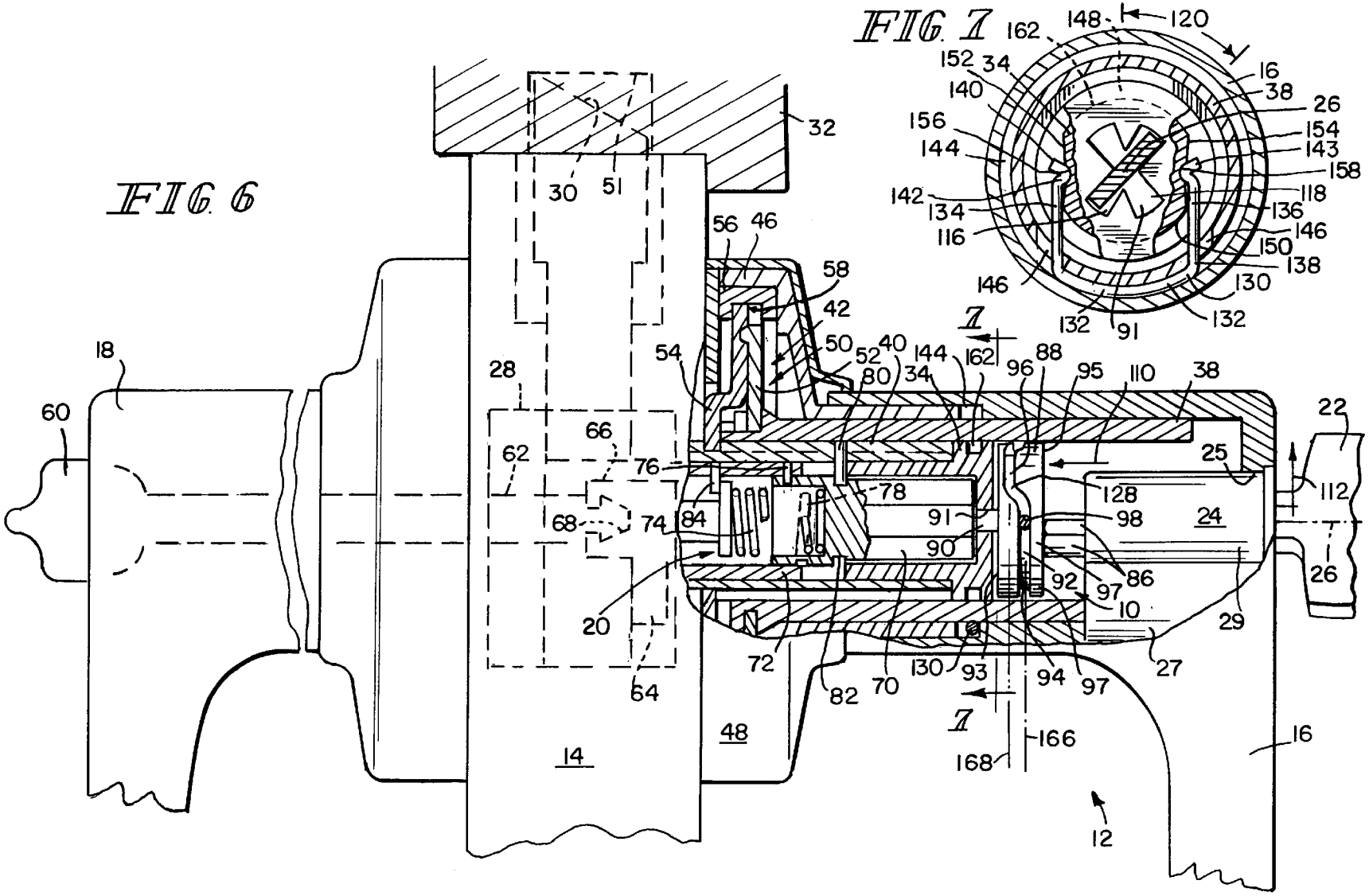
FIG. 6 is a longitudinal sectional view similar to FIG. 4 following insertion of the operating key into the lock core and rotation of the operating key in a locking direction to cause the shuttling throw member to shuttle axially inward (to the left in FIG. 6) toward the first key drive spindle so that the rectangular-shaped blade of the throw member fits into the X-shaped aperture formed in the first key drive spindle, the axial movement of the shuttling throw member being created by a camming relationship between the circumferentially-extending serpentine channel formed in the body portion of the throw member and the pin appended to the first outer spindle and arranged to extend into the circumferentially-extending serpentine channel.
FIG. 7 is a cross sectional view taken along line 7—7 of FIG. 6 showing the position of the rectangular-shaped blade of the throw member relative to the X-shaped aperture formed in the first key drive spindle after the operating key has been rotated a predetermined amount in the locking direction to place the rectangular-shaped blade within the X-shaped aperture.

The X-shaped aperture 91 formed in first key drive spindle 34 permits operating key 22 to rotate in locking direction 112 or opposite unlocking direction 114 to position rectangular-shaped blade 90 within X-shaped aperture 91. The X-shaped aperture 91 includes a first locking slot 116 and a second unlocking slot 118 that intersect to form an "X" shape. When operating key 22 is rotated in locking direction 112 to move shuttling throw member 10 axially forward in direction 110, rectangular-shaped blade 90 moves into first slot 116 as shown in FIG. 7. When operating key 22 is rotated in unlocking direction 114 to move shuttling throw member 10 axially forward in direction 110, rectangular-shaped blade 90 moves into second slot 118 as shown in FIG. 13.

In the illustrated embodiment, operating key 22 rotation in locking direction 112 locks lockset 12 and operating key 22 rotation in unlocking direction 114 unlocks lockset 12. In alternative embodiments, the locking and unlocking direction of operating key rotation may be varied.

The lockset 10 is shown in its unlocked position in FIG. 4 before operating key 22 has been inserted into lock core 24. In this position, shown in FIG. 4, shuttling throw member 10 and first key drive spindle 34 are situated in their home position and pin 98 is situated within C-shaped offset portion 96 of circumferentially extending serpentine channel 92. When pin 98 is situated within C-shaped offset portion 96, shuttling throw member 10 is positioned so that rectangular-shaped blade 90 is disengaged and spaced apart from first key drive spindle 34. Therefore, in this position, rotation of outer door handle 16 does not operate locking-unlocking mechanism 20.

When operating key 22 is inserted into lock core 24 and rotated in locking direction 112 through angle 120, shuttling throw member 10 rotates to position pin 98 in linear portion 94 of circumferentially extending serpentine channel 92 as shown in FIG. 6. As shuttling throw member 10 rotates to change the position of pin 98 from C-shaped offset portion 96 to linear portion 94, shuttling throw member 10 shuttles axially inward toward door 14 in direction 110 as pin 98 "travels" through end portion 126 of C-shaped offset 96. The rectangular-shaped blade 90 moves into locking slot 116 of X-shaped aperture 91 so that further rotation of operating key 22 is transferred to locking-unlocking mechanism 20. Further rotation of operating key 22 in locking direction 112 does not cause shuttling throw member 10 to shuttle axially until pin 98 begins to move from linear portion 94 to C-shaped offset portion 96.

In the illustrated embodiment of the invention, angle 120 is approximately 40°. However, in alternative embodiments of the invention, other angle magnitudes may be used within a range of approximately 10° to 90°.

Figures 8, 9:
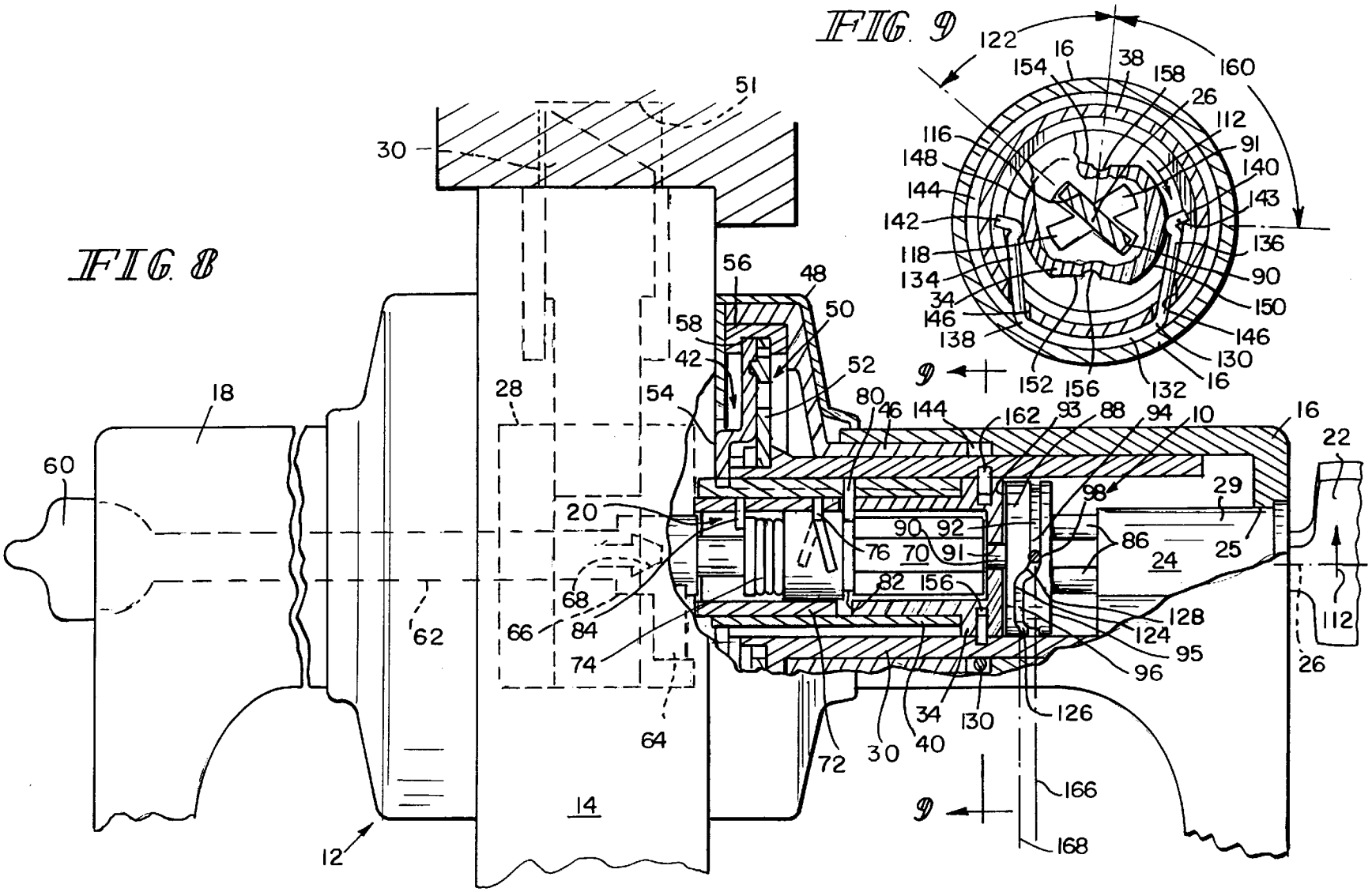
FIG. 8 is a longitudinal sectional view similar to FIG. 6 showing the position of the operating key after it has been rotated further in the locking direction from its position in FIG. 6 to move components of the lockset toward a locked position.
FIG. 9 is a cross sectional view taken along line 9—9 of FIG. 8 showing a C-shaped spring having first and second spring fingers being spread apart as the first key drive spindle is rotated by the shuttling throw member.

Once rectangular-shaped blade 90 engages X-shaped aperture 91, further operating key 22 rotation in locking direction 112 rotates first key drive spindle 34 through the position shown in FIGS. 8 and 9 where pin 98 is about to change position from linear portion 94 to end portion 128 of C-shaped offset portion 96. Further operating key 22 rotation in locking direction 112 from the position shown in FIGS. 8 and 9 causes pin 98 to "travel" through end portion 128 and shuttling throw member 10 to move axially outward so that rectangular-shaped blade 90 disengages X-shaped aperture 91.

In the illustrated embodiment, the lockset 12 is moved into the locked position once operating key 22 and first key drive spindle 34 have rotated a total of 360° as shown in FIGS. 10 and 11. In the locked position, the pin 98 is situated in middle portion 124 of C-shaped offset portion 96. To reach the locked position from the position shown in FIGS. 8 and 9, the operating key 22 must be rotated further in locking direction 112 until operating key 22 reaches its home position shown in FIGS. 10 and 11. This further operating key 22 rotation rotates circumferentially extending slot 92 of shuttling throw member 10 so that pin "travels" through end portion 128 of C-shaped offset portion 96 to move shuttling throw member 10 axially outward out of engagement with X-shaped aperture 91 as shown in FIG. 10.

Once operating key 22 has been rotated 360° to lock lockset 12 and been removed from lock core 24, as shown in FIGS. 10 and 11, the shuttling throw member 10 and first key drive spindle 34 are situated in the same home position as they were when lockset 12 was in the unlocked position as shown in FIGS. 4 and 5. The operating key 22 returns to its home position simply by the user turning operating key 22 to the home position and removing operating key 22 from lock core 24.

The first key drive spindle 34 returns to its home position with the assistance of a C-shaped spring 130 fixed within a circumferentially extending spring-receiving channel 144 formed in outer door handle 16. C-shaped spring 130 includes a base 132 situated in spring-receiving channel 144 and first and second spring fingers 134, 136 extending through spring apertures 146 formed in first spindle 38 and around first key drive spindle 34 as shown in FIGS. 4–13. The first key drive spindle 34 is formed to include a circumferentially extending slot 162 that first and second spring fingers 134, 136 lie within. The first and second spring fingers 134, 136 include a proximal end 138 appended to base 132 and a distal end 140 remote from proximal end 138. A detent 142 is formed in distal end 140 of first spring finger 134 and a detent 143 is formed in distal end 140 of second spring finger 136.

First key drive spindle 34 includes first and second curved surfaces 148, 150 and first and second angled surfaces 152, 154 connecting the curved surfaces 148, 150. Notches 156, 158 are formed in angled surfaces 152, 154 to receive detents 142, 143 when first key drive spindle 34 is in its home position as shown in FIGS. 4, 5, 10, and 11. As first key drive spindle 34 rotates from the locked position to the unlocked position, the C-shaped spring 130 remains fixed within outer door handle 16 and first spindle 38 as shown in FIGS. 4, 7, 9, and 11. The first and second spring fingers 134, 136 spread apart as first key drive spindle 34 is rotated so the first and second fingers 134, 136 engage curved surfaces 148, 150 as shown in FIG. 9.

When rectangular-shaped blade 90 begins to pull out of X-shaped aperture 91, the first key drive spindle 34 must still rotate through angle 160 shown in FIG. 9 to obtain its home position shown in FIG. 10. As pin 98 "travels" through end portion 128, the rectangular-shaped blade 90 continues to engage and rotate first key drive spindle 34 as rectangular-shaped blade 90 is moving axially outward out of X-shaped aperture 91. However, operating key 22 rotation alone does not rotate first key drive spindle 34 to its home position. The C-shaped spring 130 acts to rotate first key drive spindle 34 to its home position as detents 142, 143 on first and second spring fingers 134, 136 search for notches 156, 158 formed in angled surfaces 152, 154 of first key drive spindle 34. The C-shaped spring 130 and shuttling throw member 10 combine to rotate first key drive spindle 34 through angle 160. Angled surfaces 152, 154 are angled inward toward notches 156, 158 to assist detents 142, 143 in finding notches 156, 158. In alternative embodiments of the present invention, the angled surfaces may instead be flat surfaces.

Once locking-unlocking mechanism 20 is in its locked position, operating key 22 is in its home position and can be removed from lock core 24 as shown in FIGS. 10 and 11. In the home position, pin 98 is situated in middle portion 124 of C-shaped offset portion 96 so that rectangular-shaped blade 90 is not engaged with first key drive spindle 34.

The C-shaped spring 130 provides functions other than returning first key drive spindle 34 to the home position. C-shaped spring 130 prevents first key drive spindle 34 and locking-unlocking mechanism 20 from rotating inadvertently due to vibration. Also, C-shaped spring 130 axially fixes first key drive spindle 34 within lockset 12.

Disengaging shuttling throw member 10 from locking-unlocking mechanism 20 when operating key 22 is removed from lock core 24 helps lockset 12 remain in the locked position during an overtorque attack on lockset 12. Further, disengaging shuttling throw member 10 from locking-unlocking mechanism 20 when operating key 22 is removed from lock core 24 prevents rectangular-shaped blade 90 from shearing off within X-shaped aperture 91 or other components of lockset 12 from being damaged during an overtorque attack on lockset 12.

To unlock a locked lockset 12, operating key 22 is inserted into lock core 24 and rotated in unlocking direction 114 as shown in FIG. 12. Operating key 22 rotation through angle 164, shown in FIG. 13, rotates shuttling throw member 10 so that pin 98 "travels" through end portion 128 of C-shaped offset portion 96 into linear portion 94. Once pin 98 is situated in linear portion 94, rectangular-shaped blade 90 is situated within unlocking slot 118 of X-shaped aperture 91 as shown in FIG. 13.

In the illustrated embodiment of the invention, angle 164 is approximately 40°. However, in alternative embodiments of the invention, other angle magnitudes may be used within a range of approximately 10° to 90°.

To complete unlocking lockset 12, operating key 22, shuttling throw member 10, and first key drive spindle 34 are rotated a total of 360°. The C-shaped spring 130 assists in returning first key drive spindle 34 to its home position when lockset 10 is moved to the unlocked position just as C-shaped spring 130 assists when lockset 10 is moved to the locked position. Once operating key 22 has rotated a total of 360° to unlock lockset 12, the operating key 22 may be removed from lock core 24 to place lockset 12 in a position as shown in FIGS. 4 and 5.

Although the invention has been described in detail, with reference to certain preferred embodiments, variations and modifications exist within the scope and spirit of the invention as described and defined in the following claims.

We claim:

1. A lockset for use in a door, the lockset comprising a lock core adapted to interact with a key, a body adapted to be mounted on the door, a door handle mounted on the body for rotation relative to the door, the door handle being formed to include an aperture for receiving the lock core, a locking-unlocking mechanism being adapted to lock and unlock the lockset in response to rotation of the key within the lock core, and a throw member mounted for rotation with the lock core, the throw member including an outer perimeter edge, a blade extending toward the locking-unlocking mechanism, and a channel extending around the outer perimeter edge, the body including a pin extending into the channel so that when the key is inserted into the lock core and rotated, the lock core and throw member rotate relative to the pin to cause the throw member to move from an inactive position disengaged from the locking-unlocking mechanism to an active position wherein the blade engages the locking-unlocking mechanism, and the locking-unlocking mechanism including a key drive spindle formed to include a throw member receiving aperture to receive the blade.

2. A lockset for use in a door containing a lock core configured to rotate when a key rotates within the lock core, the lockset comprising a body adapted to be mounted on the door, a door handle mounted on the body for rotation relative to the door, the door handle being formed to include an aperture for receiving the lock core, a locking-unlocking mechanism being adapted to lock and unlock the lockset in response to rotation of the key within the lock core, a throw member mounted for rotation with the lock core, the throw member including an outer perimeter edge, a blade extending toward the locking-unlocking mechanism, and a channel extending around the outer perimeter edge, the body including a pin extending into the channel so that when a key is inserted into the lock core and rotated, the lock core and throw member rotate relative to the pin to cause the throw member to move from an inactive position disengaged from the locking-unlocking mechanism to an active position wherein the blade engages the locking-unlocking mechanism, and the locking-unlocking mechanism including a key drive spindle formed to include an x-shaped throw member-receiving aperture to receive the blade.

3. A lockset for use in a door containing a lock core configured to rotate when a key rotates within the lock core, the lockset comprising a body adapted to be mounted on the door, a door handle mounted on the body for rotation relative to the door, the door handle being formed to include an aperture for receiving the lock core, a locking-unlocking mechanism being adapted to lock and unlock the lockset in response to rotation of the key within the lock core, a throw member mounted for rotation with the lock core, the throw member including an outer perimeter edge, a blade extending toward the locking-unlocking mechanism, and a channel extending around the outer perimeter edge, the body including a pin extending into the channel so that when the key is inserted into the lock core and rotated, the lock core and throw member rotate relative to the pin to cause the throw member to move from an inactive position disengaged from the locking-unlocking mechanism to an active position wherein the blade engages the locking-unlocking mechanism, the locking-unlocking mechanism including a key drive spindle formed to include a throw member-receiving aperture to receive the blade, and the throw member receiving aperture including a first slot sized to receive the blade when the key is rotating in an unlocking direction and a second slot sized to receive the blade when the key is rotating in a locking direction.

4. The lockset of claim 3, wherein the second slot intersects the first slot.

5. A lockset for use in a door containing a lock core configured to rotate when a key rotates within the lock core, the lockset comprising a body adapted to be mounted on the door, a door handle mounted on the body for rotation relative to the door, the door handle being formed to include an aperture for receiving the lock core, a locking-unlocking mechanism being adapted to lock and unlock the lockset in response to rotation of the key within the lock core, a throw member mounted for rotation with the lock core, the throw member including an outer perimeter edge, a blade extending toward the locking-unlocking mechanism, and a channel extending around the outer perimeter edge, the body including a pin extending into the channel so that when the key is inserted into the lock core and rotated, the lock core and throw member rotate relative to the pin to cause the throw member to move from an inactive position disengaged from the locking-unlocking mechanism to an active position wherein the blade engages the locking-unlocking mechanism, and the locking-unlocking mechanism including a key drive spindle formed to include a throw member-receiving aperture to receive the blade, and a spring fixed within the body and engaging the key drive spindle.

6. The lockset of claim 5, wherein the spring includes first and second spring fingers engaging the key drive spindle.

7. The lockset of claim 6, wherein the key drive spindle is formed to include first and second notches sized to receive first and second detents formed on the first and second spring fingers.

8. The lockset of claim 7, wherein the key drive spindle includes angled surfaces situated adjacent to the first and second notches.

9. A lockset for use in a door, the lockset comprising a lock core adapted to interact with a key, a body adapted to be mounted on the door, a door handle mounted on the body for rotation relative to the door, the door handle being formed to include an aperture for receiving the lock core, a locking-unlocking mechanism mounted within the body, the locking-unlocking mechanism being adapted to lock and unlock the lockset in response to rotation of the key within the lock core, and a throw member including a throw member body mounted for rotation with the lock core, the throw member body having an axially inner end adapted to face toward the door and an axially outer end adapted to face away from the door, a blade appended to the axially inner end of the throw member body and arranged to extend axially inward toward the door, and means for shuttling axially relative to the door handle so that when the key is inserted into the lock core and rotated a predetermined amount the blade engages and rotates the locking-unlocking mechanism to lock and unlock the lockset and when the key is removed from the lock core the blade is disengaged from the locking-unlocking mechanism, the throw member body including an outer perimeter edge, the shuttling means including a channel extending about the outer perimeter edge, and the lockset further comprising a pin situated in the body of the lockset and extending into the channel.

10. The lockset of claim 9, wherein the channel varies in distance axially from the door handle so that as the throw member is rotated the pin causes the throw member to shuttle axially inwardly and outwardly relative to the door.

11. A lockset for use in a door containing a lock core configured to rotate when a key rotates within the lock core, the lockset comprising a body adapted to be mounted on the door, a door handle mounted on the body for rotation relative to the door, the door handle being formed to include an aperture for receiving the lock core, a locking-unlocking mechanism mounted within the body, the locking-unlocking mechanism being adapted to lock and unlock the lockset in response to rotation of the key within the lock core, and a throw member including a throw member body mounted for rotation with the lock core, the throw member body having an axially inner end adapted to face toward the door and an axially outer end adapted to face away from the door, a blade appended to the axially inner end of the throw member body and arranged to extend axially inward toward the door, and means for shuttling axially relative to the door handle so that when a key is inserted into the lock core and rotated a predetermined amount the blade engages and rotates the locking-unlocking mechanism to lock and unlock the lockset and when the key is removed from the lock core the blade is disengaged from the locking-unlocking mechanism, the throw member body including an outer perimeter edge, the shuttling means including a channel extending about the outer perimeter edge, the lockset further comprising a pin situated in the body of the lockset and extending into the channel, the channel varying in distance axially from the door handle so that as the throw member is rotated the pin causes the throw member to shuttle axially inwardly and outwardly relative to the door, and the channel forms a continuous loop about the outer perimeter edge of the body.

12. A lockset for use in a door containing a lock core configured to rotate when a key rotates within the lock core, the lockset comprising a body adapted to be mounted on the door, a door handle mounted on the body for rotation relative to the door, the door handle being formed to include an aperture for receiving the lock core, a locking-unlocking mechanism mounted within the body, the locking-unlocking mechanism being adapted to lock and unlock the lockset in response to rotation of the key within the lock core, and a throw member including a throw member body mounted for rotation with the lock core, the throw member body having an axially inner end adapted to face toward the door and an axially outer end adapted to face away from the door, a blade appended to the axially inner end of the throw member body and arranged to extend axially inward toward the door, and means for shuttling axially relative to the door handle so that when the key is inserted into the lock core and rotated a predetermined amount the blade engages and rotates the locking-unlocking mechanism to lock and unlock the lockset and when the key is removed from the lock core the blade is disengaged from the locking-unlocking mechanism, the throw member body including an outer perimeter edge, the shuttling means including a channel extending about the outer perimeter edge, a pin situated in the body of the lockset and extending into the channel, and the channel including a linear portion having a first end and a second end, the linear portion is spaced apart from the door an equal amount along its entire length from the first end to the second end, and an offset portion extending between the first and second ends of the linear portion, the pin is situated in the offset portion when the shuttling throw member is situated in an axially outer position disengaged from the locking-unlocking mechanism and situated in the linear portion when the shuttling throw member is situated in an axially inner position engaged with the locking-unlocking mechanism.

13. The lockset of claim 12, wherein the offset portion is generally C-shaped.

14. A lockset for use in a door, the lockset comprising a lock core adapted to interact with a key, a body adapted to be mounted on the door, a door handle mounted on the body for rotation relative to the door, the door handle being formed to include an aperture for receiving the lock core, a locking-unlocking mechanism mounted within the body, the locking-unlocking mechanism being adapted to lock and unlock the lockset in response to rotation of the key within the lock core, and a throw member including a throw member body mounted for rotation with the lock core, the throw member body having an axially inner end adapted to face toward the door and an axially outer end adapted to face away from the door, a blade appended to the axially inner end of the throw member body and arranged to extend axially inward toward the door, and means for engaging and disengaging the blade and the locking-unlocking mechanism so that when the key is inserted into the lock core and rotated the blade engages and rotates the locking-unlocking mechanism and when the key is removed from the lock core the blade is disengaged from the locking-unlocking mechanism, the lock core including an axis of rotation, the body including a pin extending inwardly toward the axis of rotation, the engaging and disengaging means including a channel formed in the throw member body, the channel having a first end and a second end and the channel varying in distance from the door along its length between the first and second ends, and the pin being configured to extend into the channel.

15. The lockset of claim 14, wherein the channel is formed on an outer perimeter edge of the throw member body.

16. The lockset of claim 14, wherein the throw member body is cylindrical.

17. A lockset for use in a door containing a lock core configured to rotate when a key rotates within the lock core, the lockset comprising a body adapted to be mounted on the door, a door handle mounted on the body for rotation relative to the door, the door handle being formed to include an aperture for receiving the lock core, a locking-unlocking mechanism mounted within the body, the locking-unlocking mechanism being adapted to lock and unlock the lockset in response to rotation of the key within the lock core, and a throw member including a throw member body having a first end, a second end, and an outer perimeter edge extending between the first and second ends, the throw member body being formed to include a circumferentially extending serpentine channel on the outer perimeter edge, at least one drive prong appended to the first end and arranged to extend away from the throw member body, and a blade appended to the second end of the throw member body and arranged to extend away from the throw member body, and the channel including a first channel portion extending along a first arcuate plane, a second channel portion extending along a second arcuate plane, and first and second end channel portions connecting the first and second channel portions.

18. A lockset for use in a door, the lockset comprising a lock core adapted to interact with a token, a housing adapted to be mounted on a door, the lock core being coupled to the housing, a locking-unlocking mechanism mounted within the housing, the locking-unlocking mechanism being adapted to lock and unlock the lockset in response to actuation of the lock core by the token, a drive member coupled to the housing, and a throw member coupled to the lock core, the drive member engaging the throw member and moving the throw member between engaged and disengaged positions with the locking-unlocking mechanism so that the throw member is engaged with the locking-unlocking mechanism when the token is interacting with the lock core and disengaged from the locking-unlocking mechanism when the token is not interacting with the lock core, the locking-unlocking mechanism including a key drive spindle formed to include an x-shaped throw member-receiving aperture, the throw member including a blade extending toward the locking-unlocking mechanism, and the blade being received within the x-shaped throw member-receiving aperture when the token is interacting with the lock core and the throw member is engaged with the locking-unlocking mechanism.

19. The lockset of claim 18, wherein the x-shaped throw member-receiving aperture includes first and second slots, the first slot of the x-shaped throw member-receiving aperture is sized to receive the blade when the lock core is actuated by the token to unlock the lockset, and the second slot of the x-shaped throw member-receiving aperture is sized to receive the blade when the lock core is actuated by the token to lock the lockset.

20. The lockset of claim 18, wherein the throw member includes an outer perimeter edge and a channel forming a continuous loop about the outer perimeter edge of the throw member and the drive member is configured to engage the channel of the throw member to move the throw member between the engaged and disengaged positions with the locking-unlocking mechanism.

21. The lockset of claim 18, wherein the throw member includes an outer perimeter edge and a channel extending about the outer perimeter edge, the channel includes a linear portion having a first end and a second end, the linear portion is spaced apart from the door an equal amount along its entire length from the first end to the second end, and an offset portion extending between the first and second ends of the linear portion, and the drive member is situated in one of the offset portion and linear portion when the throw member is disengaged from the locking-unlocking mechanism and is situated in the other of the linear portion and offset portion when the throw member is engaged with the locking-unlocking mechanism.

22. The lockset of claim 18, wherein the throw member includes an outer perimeter edge and a channel extending about the outer perimeter edge, the channel includes a first channel portion extending along a first arcuate plane, a second channel portion extending along a second arcuate plane, and first and second end channel portions connecting the first and second channel portions.

23. A lockset for use in a door, the lockset comprising a lock core adapted to interact with a token, a housing adapted to be mounted on a door, the lock core being coupled to the housing, a locking-unlocking mechanism mounted within the housing, the locking-unlocking mechanism being adapted to lock and unlock the lockset in response to actuation of the lock core by the token, a drive member coupled to the housing, and a throw member coupled to the lock core, the drive member engaging the throw member and moving the throw member between engaged and disengaged positions with the locking-unlocking mechanism so that the throw member is engaged with the locking-unlocking mechanism when the token is interacting with the lock core and disengaged from the locking-unlocking mechanism when the token is not interacting with the lock core, the locking-unlocking mechanism including a key drive spindle having a throw member-receiving aperture, the throw member-receiving aperture including first and second slots, the throw member including a blade extending toward the locking-unlocking mechanism, and the first slot of the throw member-receiving aperture being sized to receive the blade when the lock core is actuated by the token to unlock the lockset and the second slot of the throw member-receiving aperture being sized to receive the blade when the lock core is actuated by the token to lock the lockset.

24. The lockset of claim 23, wherein the throw member includes an outer perimeter edge and a channel forming a continuous loop about the outer perimeter edge of the throw member and the drive member is configured to engage the channel of the throw member to move the throw member between the engaged and disengaged positions with the locking-unlocking mechanism.

25. The lockset of claim 23, wherein the throw member includes an outer perimeter edge and a channel extending about the outer perimeter edge, the channel includes a linear portion having a first end and a second end, the linear portion is spaced apart from the door an equal amount along its entire length from the first end to the second end, and an offset portion extending between the first and second ends of the linear portion, and the drive member is situated in one of the offset portion and linear portion when the throw member is disengaged from the locking-unlocking mechanism and is situated in the other of the linear portion and offset portion when the throw member is engaged with the locking-unlocking mechanism.

26. The lockset of claim 23, wherein the throw member includes an outer perimeter edge and a channel extending about the outer perimeter edge, the channel includes a first channel portion extending along a first arcuate plane, a second channel portion extending along a second arcuate plane, and first and second end channel portions connecting the first and second channel portions.

27. A lockset for use in a door, the lockset comprising lock core adapted to interact with a token, a housing adapted to be mounted on a door, the lock core being coupled to the housing, a locking-unlocking mechanism mounted within the housing, the locking-unlocking mechanism being adapted to lock and unlock the lockset in response to actuation of the lock core by the token, a drive member coupled to the housing, and a throw member coupled to the lock core, the drive member engaging the throw member and moving the throw member between engaged and disengaged positions with the locking-unlocking mechanism so that the throw member is engaged with the locking-unlocking mechanism when the token is interacting with the lock core and disengaged from the locking-unlocking mechanism when the token is not interacting with the lock core, the throw member including an outer perimeter edge and a channel forming a continuous loop about the outer perimeter edge of the throw member, and the drive member being configured to engage the channel of the throw member to move the throw member between the engaged and disengaged positions with the locking-unlocking mechanism.

28. The lockset of claim 27, wherein the channel includes a linear portion having a first end and a second end, the linear portion is spaced apart from the door an equal amount along its entire length from the first end to the second end, and an offset portion extending between the first and second ends of the linear portion, and the drive member is situated in one of the offset portion and linear portion when the throw member is disengaged from the locking-unlocking mechanism and is situated in the other of the linear portion and offset portion when the throw member is engaged with the locking-unlocking mechanism.

29. The lockset of claim 27, wherein the channel includes a first channel portion extending along a first arcuate plane, a second channel portion extending along a second arcuate plane, and first and second end channel portions connecting the first and second channel portions.

30. A lockset for use in a door, the lockset comprising a lock core adapted to interact with a token, a housing adapted to be mounted on a door, the lock core being coupled to the housing, a locking-unlocking mechanism mounted within the housing, the locking-unlocking mechanism being adapted to lock and unlock the lockset in response to actuation of the lock core by the token, a drive member coupled to the housing, and a throw member coupled to the lock core, the drive member engaging the throw member and moving the throw member between engaged and disengaged positions with the locking-unlocking mechanism so that the throw member is engaged with the locking-unlocking mechanism when the token is interacting with the lock core and disengaged from the locking-unlocking mechanism when the token is not interacting with the lock core, the throw member including an outer perimeter edge and a channel extending about the outer perimeter edge, the channel including a linear portion having a first end and a second end, the linear portion being spaced apart from the door an equal amount along its entire length from the first end to the second end, and an offset portion extending between the first and second ends of the linear portion, and the drive member being situated in one of the offset portion and linear portion when the throw member is disengaged from the locking-unlocking mechanism and being situated in the other of the linear portion and offset portion when the throw member is engaged with the locking-unlocking mechanism.

31. A lockset for use in a door, the lockset comprising a lock core adapted to interact with a token, a housing adapted to be mounted on a door, the lock core being coupled to the housing, a locking-unlocking mechanism mounted within the housing, the locking-unlocking mechanism being adapted to lock and unlock the lockset in response to actuation of the lock core by the token, a drive member coupled to the housing, and a throw member coupled to the lock core, the drive member engaging the throw member and moving the throw member between engaged and disengaged positions with the locking-unlocking mechanism so that the throw member is engaged with the locking-unlocking mechanism when the token is interacting with the lock core and disengaged from the locking-unlocking mechanism when the token is not interacting with the lock core, the throw member including an outer perimeter edge and a channel extending about the outer perimeter edge, and the channel including a first channel portion extending along a first arcuate plane, a second channel portion extending along a second arcuate plane, and first and second end channel portions connecting the first and second channel portions.

* * * * *